US009011083B2

(12) United States Patent
De Martino

(10) Patent No.: US 9,011,083 B2
(45) Date of Patent: Apr. 21, 2015

(54) SEAL ARRANGEMENT FOR A GAS TURBINE

(75) Inventor: Marcello De Martino, Munich (DE)

(73) Assignee: MTU Aero Engines GmbH, Munich (DE)

( * ) Notice: Subject to any disclaimer, the term of this patent is extended or adjusted under 35 U.S.C. 154(b) by 2741 days.

(21) Appl. No.: 10/576,035

(22) PCT Filed: Sep. 30, 2004

(86) PCT No.: PCT/DE2004/002174

§ 371 (c)(1),
(2), (4) Date: May 2, 2007

(87) PCT Pub. No.: WO2005/040561

PCT Pub. Date: May 6, 2005

(65) Prior Publication Data

US 2007/0274825 A1 Nov. 29, 2007

(30) Foreign Application Priority Data

Oct. 17, 2003 (DE) ..... 103 48 290

(51) Int. Cl.
*F01D 5/20* (2006.01)
*F01D 11/02* (2006.01)
*F01D 11/00* (2006.01)

(52) U.S. Cl.
CPC ..... *F01D 11/02* (2013.01); *F01D 11/001* (2013.01); *F05D 2240/55* (2013.01); *F05D 2240/80* (2013.01); *F05D 2250/283* (2013.01)

(58) Field of Classification Search
USPC ..... 415/170.1, 173.1, 173.3, 173.4, 173.5, 415/173.6, 174.4, 174.5, 230
See application file for complete search history.

(56) References Cited

U.S. PATENT DOCUMENTS

| | | | | | |
|---|---|---|---|---|---|
| 1,689,735 | A | * | 10/1928 | Losel | 277/419 |
| 1,756,958 | A | * | 5/1930 | Schmidt | 415/131 |
| 1,857,961 | A | * | 5/1932 | Lamb | 277/413 |
| 4,351,532 | A | * | 9/1982 | Laverty | 277/419 |
| 4,513,975 | A | * | 4/1985 | Hauser et al. | 277/415 |
| 5,029,876 | A | * | 7/1991 | Orlando et al. | 277/419 |
| 5,118,253 | A | * | 6/1992 | Balkcum, III | 415/209.2 |
| 5,127,797 | A | * | 7/1992 | Carman | 415/209.2 |
| 5,218,816 | A | * | 6/1993 | Plemmons et al. | 60/806 |

(Continued)

FOREIGN PATENT DOCUMENTS

| | | | |
|---|---|---|---|
| DE | 199 31 765 | A1 | 1/2001 |
| EP | 1 254 968 | A1 | 11/2002 |
| EP | 1 347 152 | A2 | 9/2003 |

*Primary Examiner* — Edward Look
*Assistant Examiner* — Aaron R Eastman
(74) *Attorney, Agent, or Firm* — Crowell & Moring LLP

(57) ABSTRACT

A seal arrangement for a gas turbine is disclosed. The seal arrangement is used for sealing a gap between radially internally located ends of guide vanes of a guide vane ring and a rotor, in which case the rotor has at least two seal projections positioned at an axial distance relative to each other in a circumferential direction of the rotor. The seal projections effecting a seal of the gap in combination with intake linings associated with the radially internally located ends of the guide vanes. The seal projections are inclined or tilted in the axial direction toward a side of higher pressure, where, in a space limited by the minimum of two seal projections and the corresponding intake linings, at least one recirculation structure is provided. The recirculation structure, or each recirculation structure, is oriented toward the side of the higher pressure.

9 Claims, 1 Drawing Sheet

(56) References Cited

U.S. PATENT DOCUMENTS

| | | | | | |
|---|---|---|---|---|---|
| 5,236,302 | A | * | 8/1993 | Weisgerber et al. | 415/173.7 |
| 5,244,216 | A | * | 9/1993 | Rhode | 277/303 |
| 5,281,090 | A | * | 1/1994 | Starling | 277/413 |
| 5,320,488 | A | * | 6/1994 | Meade et al. | 415/173.7 |
| 5,333,993 | A | * | 8/1994 | Stueber et al. | 415/174.5 |
| 5,354,174 | A | * | 10/1994 | Balkcum et al. | 415/209.2 |
| 5,380,155 | A | | 1/1995 | Varsik et al. | |
| 5,749,701 | A | * | 5/1998 | Clarke et al. | 415/115 |
| 5,833,244 | A | * | 11/1998 | Salt et al. | 277/421 |
| 5,984,630 | A | * | 11/1999 | Di Salle et al. | 415/174.5 |
| 6,969,239 | B2 | * | 11/2005 | Grant et al. | 416/220 R |
| 7,241,109 | B2 | * | 7/2007 | Ferra | 415/174.5 |
| 7,264,442 | B2 | * | 9/2007 | Harding | 415/173.7 |
| 7,556,474 | B2 | * | 7/2009 | Marchi | 415/115 |
| 2004/0151582 | A1 | * | 8/2004 | Faulkner | 415/173.1 |
| 2006/0133928 | A1 | * | 6/2006 | Bracken et al. | 415/173.4 |
| 2008/0014077 | A1 | * | 1/2008 | Hopkins | 415/174.4 |
| 2009/0129916 | A1 | * | 5/2009 | Young et al. | 415/115 |

* cited by examiner

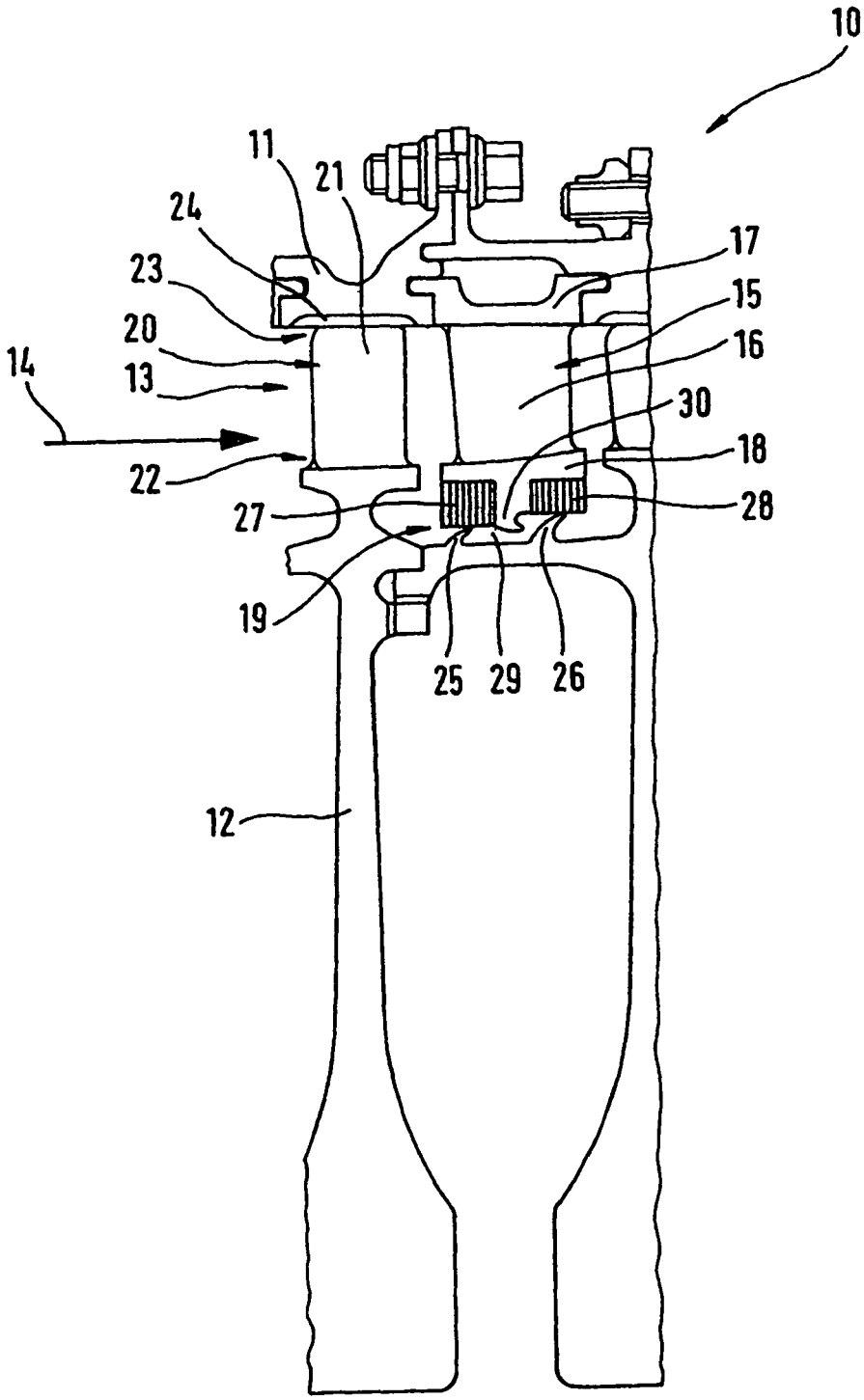
10
11
21
24
23
20
13
14
22
27
19
17
15
16
30
18
28
25
29
26
12

SEAL ARRANGEMENT FOR A GAS TURBINE

This application claims the priority of International Application No. PCT/DE2004/002174, filed Sep. 30, 2004, and German Patent Document No. 103 48 290.3, filed Oct. 17, 2003, the disclosures of which are expressly incorporated by reference herein.

BACKGROUND AND SUMMARY OF THE INVENTION

The invention relates to a seal arrangement for a gas turbine.

Gas turbines consist of several assemblies, for example, of a fan, a combustion chamber, preferably several compressors, as well as several turbines. The preferably several turbines are, in particular, a high-pressure turbine, as well as a low-pressure turbine; the several compressors are, in particular, a high-pressure compressor and a low-pressure compressor.

Considering a turbine, as well as a compressor of a gas turbine, several guide vane rings are positioned in series in the axial direction or in the direction of flow of the gas turbine, in which case each guide vane ring has several circumferentially arranged guide vanes. Positioned between each two adjacent guide vane rings is one rotor blade ring having several rotor blades. The rotor blades are associated with a rotor and rotate together with the rotor relative to a stationary housing, as well as relative to the also stationary guide vanes of the guide vane rings.

In order to optimize the degree of efficiency of a gas turbine, it is necessary to avoid any leakage between the rotating rotor blades and the stationary housing, on one hand, and between the stationary guide vanes and the rotor, on the other hand, by using effective sealing systems. Prior art has already disclosed the use of special intake linings for sealing the gap between the radially external ends of the rotor blades and the stationary housing, in which case the intake linings are applied to the stationary housing in order to permit a wear-free gentle moving contact of the radially external ends of the rotating rotor blades into the intake lining. Furthermore, prior art has disclosed seal arrangements, which are used to seal a gap between the radially internal ends of the stationary guide vanes and the rotor of the gas turbine, the seal arrangements being configured in such a manner that the rotor comprises at least two seal projections extending in the circumferential direction of the rotor and being positioned at an axial distance from each other, the seal projections communicating with the intake linings that are associated with the radially internal ends of the stationary guide vanes.

The present invention relates to a seal arrangement for sealing the gap between radially internal ends of the guide vanes of a guide vane ring and a rotor of the gas turbine.

Considering this, the object of the invention is to provide a novel seal arrangement for a gas turbine.

In accordance with the invention, the seal projections are inclined or tilted in the axial direction toward a side of higher pressure, whereby, in a space limited by the minimum of two seal projections and the corresponding intake linings, at least one recirculation structure is provided, and whereby the recirculation structure, or the recirculation structures, is or are oriented toward the side of the higher pressure.

In accordance with an advantageous development of the invention, the seal projections are configured as seal fins and the intake linings are configured as honeycomb structures.

Preferably, the seal projections, which communicate with a guide vane ring, and the corresponding intake linings of the guide vane ring have different radii, in which case the outer radii of the seal projections, as well as the inner radii of the intake linings, increase or become greater in the direction toward the side of the higher pressure.

BRIEF DESCRIPTION OF THE DRAWINGS

Referring to the drawing, exemplary embodiments of the invention will be explained in detail.

FIG. 1 is a partial longitudinal section of a compressor in axial configuration in the region of a guide vane ring in order to illustrate the inventive seal arrangement.

DETAILED DESCRIPTION OF THE DRAWINGS

Referring to FIG. 1, the present invention will be described in greater detail hereinafter.

FIG. 1 shows a schematic cross-section of a compressor 10 of a gas turbine with a stationary housing 11 and a rotor 12 rotating relative to the stationary housing 11, the stationary housing 11 and the rotor 12 limiting a main flow channel 13. In FIG. 1, the arrow 14 indicates the direction of flow of the main flow channel 13.

Several stationary guide vane rings 15 are arranged in series in the axial direction or in the direction of flow in the main flow channel 13, whereby FIG. 1 shows only one such guide vane ring 15. Each guide vane ring 15 is made up of several guide vanes 16, which are arranged in an axial position of the compressor 10 in a circumferential direction of the compressor around the rotor 12. The stationary guide vanes 16 are integrated in the housing 11 by means of a radially external end 17. A gap 19 is formed between the radially internal end 18 of the guide vanes 16 opposite the radially external end 17 and the rotor 12.

A rotor blade ring is provided between each two adjacent stationary guide vane rings 15. FIG. 1 shows such a rotor blade ring 20 which is made up of several rotor blades 21, which are attached with one radially internal end 22 to the rotor 12. A gap is also formed between the radially external end 23 of the rotor blades 21 and the housing 11 of the compressor 10. In order to seal this radial gap between the radially external ends 23 of the rotating rotor blades 21 and the stationary housing 11, the housing 11 is associated with a so-called intake lining 24 which permits a low-wear gentle moving contact of the radially external ends 23 of the rotor blades 21 into the housing 11 of the compressor 10.

The present invention relates to a seal arrangement for sealing the gap 19 between the radially internal ends 18 of the stationary guide vanes 16 of a guide vane ring 15 and the rotor 12 of the compressor 10. Referring to the shown preferred exemplary example in accordance with FIG. 1, this seal arrangement comprises two seal projections 25 and 26 that are associated with the rotor 12. However, more than two seal projections may be provided. The seal projections 25 and 26 are configured as so-called seal fins and are at a distance from each other in the axial direction of the compressor 10. The seal projections 25 and 26 extend over the entire circumference of the rotor 12, i.e., they are closed in circumferential direction. The seal projections 25 and 26 communicate with the intake linings 27 and 28. The intake linings 27 and 28 are associated with the radially internal ends 18 of the stationary guide vanes 16, i.e., they are integrated in the radially internal ends 18 of the guide vanes 16 that are configured as a platform. Accordingly, the intake linings 27 and 28 are designed in a stationary manner, and the seal projections 25 and 26 rotate together with the rotor 12 relative to the stationary intake linings 27 and 28. The intake linings 27 and 28 are preferably configured as honeycomb seals, whereby the honeycombs of these honeycomb structures are open in the direction toward the seal projections 25 and 26.

Referring to the compressor 10 of a gas turbine shown in FIG. 1, the gas pressure inside the compressor increases in the direction of flow (arrow 14). Within the meaning of the present invention, the seal projections 25 and 26, which, as already mentioned, are configured as seal fins, are inclined or tilted in the axial direction toward a side of higher gas pressure. This is apparent from FIG. 1. Thus, FIG. 1 shows that the direction of flow of the main flow channel 13 of the compressor 10 is from left to right, i.e., a gas pressure on the right side of the guide vanes 16 is higher than a gas pressure on the left side of the vanes. The tips of the seal projections 25 and 26 are inclined toward the right side, i.e., toward the side of the higher gas pressure. As a result, the sealing effect of the seal projections 25 and 26 is optimized.

Furthermore, in accordance with the invention, a recirculation structure 30 is arranged in a space 29 limited by the seal projections 25 and 26, as well as by the corresponding intake linings 27 and 28. In so doing, the recirculation structure 30 is integrated into the radially internal end 18 of the guide vanes 16 of the guide vane ring 15, the radially internal ends 18 being configured as the platform of the guide vanes 16. In accordance with FIG. 1, the intake linings 27 and 28, which are also associated with the radially internal end 18 of the guide vanes 16, are arranged on both sides of the recirculation structure 30. Within the meaning of the present invention, the recirculation structure 30, as well as the seal projections 25 and 26, are oriented toward the side of the higher gas pressure. By integrating a thusly configured recirculation structure 30 in the seal arrangement of the seal projections 25 and 26, as well as the corresponding intake linings 27 and 28, the sealing effect is again optimized.

Referring to FIG. 1, the two seal projections 25 and 26, as well as the two intake linings 27 and 28 that communicate with the two seal projections 25 and 26 have graduated radii. The seal projection 26, which is downstream in the direction of flow (arrow 14) and which, in a compressor, is thus arranged on the side of the higher gas pressure like the upstream seal projection 25, has a greater outer radius than the upstream seal projection 25. Consequently, also the intake lining 28 communicating with the downstream seal projection 26 has a larger inner diameter than the intake lining 27 communicating with the upstream seal projection 25. The recirculation structure 30 projects beyond the downstream intake lining 28 in the radial direction.

Although, as already mentioned above, the schematic illustration of FIG. 1 shows only one guide vane ring 15, several such guide vane rings are positioned in series in the axial direction in the compressor 10. In so doing, a seal arrangement as described above for sealing the radial gap 19 between the radially internal ends 18 of the stationary guide vanes and the rotor 12 can be arranged in the region of each guide vane ring.

The present invention is preferably used for reducing any leakage in so-called stator well cavities of high-pressure compressors of an aircraft engine. Although the use in high-pressure compressors in aircraft engines is preferred, the inventive seal arrangement can also be used in the turbines of aircraft engines or even in stationary gas turbines.

The invention claimed is:

1. A seal arrangement for a gas turbine for sealing a gap between a radially internally located end of a guide vane of a guide vane ring and a rotor, comprising at least two seal projections disposed on the rotor, positioned at an axial distance relative to each other, in a circumferential direction of the rotor, the seal projections providing a seal of the gap in combination with intake linings configured as honeycomb structures and associated with the radially internally located end of the guide vane, wherein the seal projections are inclined in an axial direction toward a side of higher pressure, and wherein, in a space limited by the two seal projections and the intake linings, at least one recirculation structure is provided and oriented toward the side of higher pressure.

2. The seal arrangement according to claim 1, wherein the recirculation structure is integrated in a radially internally located platform of the guide vane of the guide vane ring.

3. The seal arrangement according to claim 1, wherein the seal projections are configured as seal fins.

4. The seal arrangement according to claim 1, wherein a honeycomb of the honeycomb structures is configured such it is open in a direction toward the seal projections.

5. The seal arrangement according to claim 1, wherein the seal projections and intake linings have different radii, wherein an outer radii of the seal projections, as well as an inner radii of the intake linings, increase in the direction toward the side of higher pressure.

6. A turbocompressor in axial construction and/or diagonal construction and/or radial construction, comprising a seal arrangement according to claim 1.

7. An aircraft engine comprising a turbocompressor according to claim 6.

8. A stationary gas turbine comprising a turbocompressor according to claim 6.

9. A seal for a gas turbine, comprising:

at least two seal projections disposed on a rotor;

at least two intake linings on a radially internal end of a stationary guide vane, wherein the at least two intake linings are configured as honeycomb structures and are disposed opposite the at least two seal projections; and a recirculation structure disposed on the radially internal end of the stationary guide vane and between the at least two seal projections on the rotor.

* * * * *